US006312573B1

(12) United States Patent
Dwyer et al.

(10) Patent No.: US 6,312,573 B1
(45) Date of Patent: Nov. 6, 2001

(54) CORNER INSERT FOR EDGE STRIPS USED WITH MODIFIED ELECTRODES FOR ELECTROLYTIC PROCESSES

(75) Inventors: Michael P. Dwyer; Manuel G. Santoyo; David Watson, all of Tucson, AZ (US)

(73) Assignee: Quadna, Inc., Tucson, AZ (US)

( * ) Notice: Subject to any disclaimer, the term of this patent is extended or adjusted under 35 U.S.C. 154(b) by 0 days.

(21) Appl. No.: 09/579,653

(22) Filed: May 26, 2000

(51) Int. Cl.[7] ..... C25B 9/00
(52) U.S. Cl. ..... 204/279; 204/281
(58) Field of Search ..... 204/279, 280, 204/281

(56) References Cited

U.S. PATENT DOCUMENTS 5,690,798 11/1997 Alexander et al. ..... 204/279
6,017,429 * 1/2000 Persson ..... 204/280
6,193,862 * 2/2001 Cutmore et al. ..... 204/279

* cited by examiner

*Primary Examiner*—Bruce F. Bell
(74) *Attorney, Agent, or Firm*—Antonio R. Durando; Durando Birdwell & Janke, PLC

(57) ABSTRACT

A nonconductive insert is provided to fill the void resulting from the removal of mother-plate corners wrapped within the abutting ends of side and bottom edge strips. The insert includes at least one anchor, adapted to frictionally engage the end of a strip mounted along the edge of the mother plate. The insert and its anchors are designed to completely fill the void left by the missing mother-plate corner, thereby preventing penetration of electrolyte and accumulation of deposits. According to other embodiments of the invention, the insert may be incorporated into the edge-strip end as an integral component of the strip.

19 Claims, 4 Drawing Sheets

CORNER INSERT FOR EDGE STRIPS USED WITH MODIFIED ELECTRODES FOR ELECTROLYTIC PROCESSES

BACKGROUND OF THE INVENTION

1. Field of the Invention

The invention relates generally to electrolytic processes and apparatus for refining metals and, in particular, to an improved edge strip assembly for mother plates that have been modified by the removal of corner portions.

2. Description of the Prior Art

Electrolysis is utilized to extract metals and other cations from an electrolytic solution. The extraction process involves passing an electric current through an electrolyte solution of a metal of interest, such as copper, gold, silver, or lead. The metal is extracted by electrical deposition as a result of current flow between alternating anode and cathode plates immersed in cells of an extraction tank house. In electrowinning processes, a solution of metal-rich electrolyte is circulated through the extraction cells. The cathode is generally constructed of a metal alloy, such as titanium or copper alloys, and various grades of stainless steel which are resistant to corrosive acid solutions. Typically, each cathode consists of a thin sheet of metal of uniform thickness, e.g., 2–mm, disposed vertically between parallel sheets of anodic material, so that a uniform current density is maintained throughout the surface of the cathode. A pure layer of metal is electrodeposited on the cathode surface, which thus becomes plated during the process, upon passing of an electric current through the electrolyte.

Similarly, in refinery metal-purification processes, an anode of impure metal is placed in an electrolytic solution of the same metal and subjected to an electric current passing through the anode, the electrolyte and the cathode of each cell. The anode goes into solution, thereby separating the metal from impurities, which drop to the bottom of the tank. The electrical current then produces the deposition of the dissolved metal in pure form on the cathode, which typically consists of a mother plate of stainless steel. When a certain amount of pure metal has been plated onto the mother plate, the cathode is pulled out of the tank and stripped of the pure metal.

In both processes, the pure metal deposit is grown to a specific thickness in sheets deposited on each side of the cathode, and then the cathode is removed from the cell and stripped. For quality control purposes, it is very desirable that these sheet deposits be uniform in shape and thickness, so that they can be easily removed by automated stripping equipment. The overall economy of the production process depends in part on the ability to mechanically strip the cathodes of the metal sheets at high throughputs and speeds without utilizing manual or physical intervention. To that end, the mother plates have a surface finish that is resistant to the corrosive solution of the tank house and is strong enough to withstand continuous handling by automated machines without pitting or marking. Any degradation of the finish of the blank causes the electrodeposited metal to bond with the cathode resulting in difficulty of removal and/or contamination of the deposited metal.

If deposition is allowed to occur at the edges of a cathode, metallic bridges form between the deposited sheets on either side of the cathode. These metallic bridges, which can wrap around the edges of the cathode, hinder the stripping operation and can cause damage to the sheets and/or the cathode. To alleviate this problem, nonconductive strips known as edge strips or protector strips are placed over the submerged bottom and side edges of the cathode. The edge strips are normally mechanically fixed to the cathode with glued pins or pin inserts. In addition to inhibiting the formation of metallic bridges, edge strips function to prevent direct contact between the cathode and the adjacent anodes.

As is well understood in the art, at each lower corner of a cathode the vertical edge strips, mounted on the side edges of the mother plate, define junctions with the horizontal edge strip mounted on the bottom edge. Often glue is applied to these junctions to prevent penetration of the electrolyte into, and an accompanying deposition of metal around, the junctions. However, over time, the glue develops cracks which permit leakage of the electrolyte into the junctions. Eventually, the edge strips must be removed to allow removal of deposits accumulated on the edge of the cathode in the junction areas. The process of removing the edge strips, cleaning the cathode and replacing the edge strips is time-consuming and also keeps the cathode out of service; therefore, it is very undesirable.

In order to further reduce the likelihood of electrolyte penetration into corner junctions, manufacturers have improved the fit between abutting parts of adjoining strips. This objective has required greater precision finishing of the edge strips and more accurate positioning of the strips on the cathode during installation, so that manufacturing as well as mounting costs have increased. To obtain a better fit, edge strips are sometimes also mitered, which further increases manufacturing and installation time.

U.S. Pat. No. 5,690,798 describes a corner protector designed to wrap around the side and bottom edge strips abutting at the lower corners of a mother plate. The protector has a vertical channel adapted to receive the lower end of a vertical edge strip, a horizontal channel adapted to receive an end of the bottom edge strip, and a cutout for the corner of the mother plate. Thus, the protector provides additional separation between the edges of the cathode and the electrolytic solution, but it involves the use of an additional component with attendant supply, installation and maintenance costs.

A notable improvement recently found in the art, based on a different approach to reducing electrodeposition at the lower corners of cathodes, has been to cut away the corner portions of the mother plate covered by abutting side and bottom edge strips. Thus, the accumulation of electrolyte deposits is avoided by eliminating the metallic substrate upon which deposition may occur. Unfortunately, though, electrolyte seepage still causes deposition along the edges of the cut-away corners covered by the edge strips. The use of caulking and/or binding material, such as silicone, to seal the abutting parts of adjoining edge strips delays but does not prevent the eventual penetration of electrolyte and accumulation of deposits.

Therefore, there is still a need for an improved system of cathode-edge protection designed to overcome these problems, especially the accumulation in the corner areas of the mother plate. The present invention provides a new edge-strip component that fulfills this need for mother plates that have been modified by the corner cut-away approach described above.

SUMMARY OF THE INVENTION

The main object of the invention is an edge strip system that reduces the accumulation of electrolyte at the lower corners of cathode mother plates.

In particular, an object of the invention is a system intended for application with mother plates where the lower corners have been removed.

An additional object of the invention is to provide an accessory component suitable for use with existing side and bottom edge strips.

One more objective of the invention is to provide a method of protecting the lower corners of an electrode assembly so as to enable operation for longer periods of time without cleaning.

A final objective is a system that can be implemented economically according to the above stated criteria.

According to the preceding objects, as well as others that will become apparent as the description proceeds, the invention consists of a nonconductive insert adapted to fill the void resulting from the absence of mother-plate corners wrapped within the abutting ends of side and bottom edge strips. In the preferred embodiment of the invention, the insert comprises a plate of dimensions commensurate with the metal corner removed from the mother plate, so that the resulting void is filled. The insert includes at least one anchor, preferably two, adapted to frictionally engage the end of a strip mounted along the edge of the mother plate. If two anchors are used, they are disposed at a right angle to make it possible to attach the insert to both edge-strip ends coming together at a corner of the mother plate. The insert and its anchors are designed to completely fill the void left by the missing mother-plate corner, thereby preventing penetration of electrolyte and accumulation of deposits. Additional protection and stability of assembly may be provided by bonding the insert to both adjoining edge-strip ends with glue.

According to other embodiments of the invention, the insert may be incorporated into the edge-strip end as an integral component of the strip. In such case, the end of the integrated insert may include a lateral anchor adapted for frictional engagement of the end of a conventional edge strip to form a corner junction. This design is particularly suitable for injection molded manufacture. When a single, vertical edge strip is used (bottom edge strips are sometimes not utilized), the lateral anchor is not necessary.

Thus, the insert of the invention, whether implemented as an accessory to or as an integral component of an edge strip, serves as a plug for the missing corner of a modified electrode and a filler for the resulting void left within adjacent corner ends of the side and bottom strips mounted on the edges of the mother plate. The insert prevents seepage of electrolyte to the corner site and to adjacent portions of the mother-plate edges encased in the edge strips, so that less frequent cleaning of the corner areas is required.

Another aspect of the invention resides in a method of making an electrolytic electrode assembly. The method comprises the steps of providing an electrode having a first edge, a second edge perpendicular to the first edge, and an inset corresponding to the removal of a corner portion at the intersection of the two edges; placing a first edge strip over the first edge so that an end thereof is in the region of the intersection; placing a second edge strip over the second edge so that an end thereof is in the region of the intersection; and replacing the missing corner portion of the electrode with a insert of nonconductive material confined by the ends of the first and second edge strips. The method can further comprise the step of adhesively connecting the insert to the ends of the edge strips.

Various other purposes and advantages of the invention will become clear from its description in the specification that follows and from the novel features particularly pointed out in the appended claims. Therefore, to the accomplishment of the objectives described above, this invention consists of the features hereinafter illustrated in the drawings, fully described in the detailed description of the preferred embodiment and particularly pointed out in the claims. However, such drawings and description disclose but one of the various ways in which the invention may be practiced.

DESCRIPTION OF THE PREFERRED EMBODIMENTS

The gist of the invention resides in the idea of providing a nonconductive insert to replace the portion of a mother-plate corner removed to avoid deposition of electrolyte at the corner junctions between side and bottom edge strips. For the purposes of this disclosure, the terms "modified electrode" and "modified mother plate" are intended to refer to conventional electrodes and mother plates where the bottom corners have been so removed.

Figure 1:
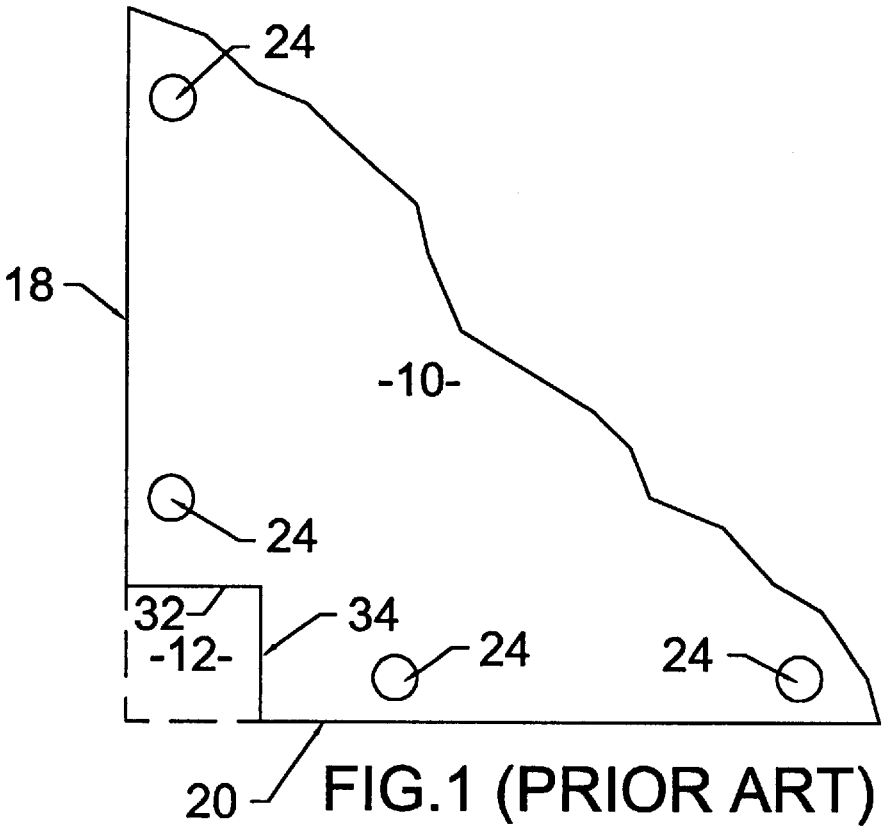
FIG.1 (PRIOR ART)
FIG. 1 is an elevational, fragmentary view of a mother plate found in prior art where a corner section has been cut out to prevent accumulation of deposits resulting from electrolyte seepage into a corner junction of edge strips.

Referring to the drawings, wherein like parts are referred to throughout with like numerals and symbols, FIG. 1 is a partial view of a modified mother plate 10 having a corner section 12 removed (shown in phantom line), as explained above. Conventional edge strips 14, as illustrated in cross-section in FIG. 2, include a longitudinal channel 16 adapted to receive an edge 18 (or 20) of the mother plate in tight connection to prevent seepage of electrolyte inside the strip. A wider longitudinal slot 22, running within the channel 16, is provided to receive retaining pins 24 inserted through and protruding on both sides from the border of the mother plate. Each edge strip is installed on the mother plate by sliding the slot 22 over the pins 24, so that the strip becomes engaged by the pins and firmly retained in place over the border of the electrode to protect its edge. The length of the pins 24 is preferably chosen to be approximately the same as the width of the slot 22 to ensure firm installation and durability of the resulting assembly.

Figure 3:
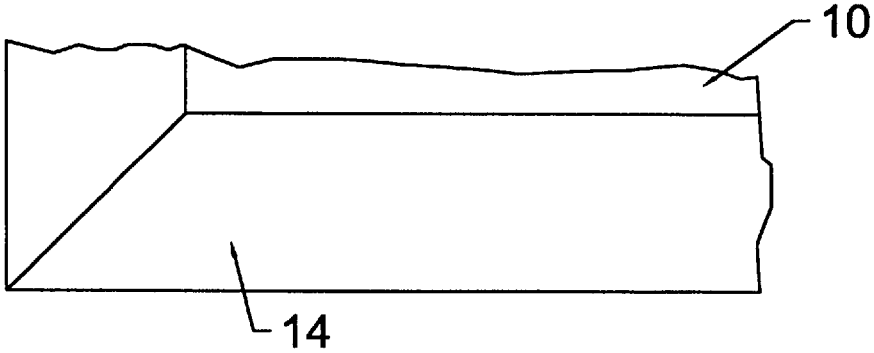
FIG.3 (PRIOR ART)
FIG. 3 is an elevational view of a corner junction between two mitered edge strips according to conventional practice.
Figure 4:
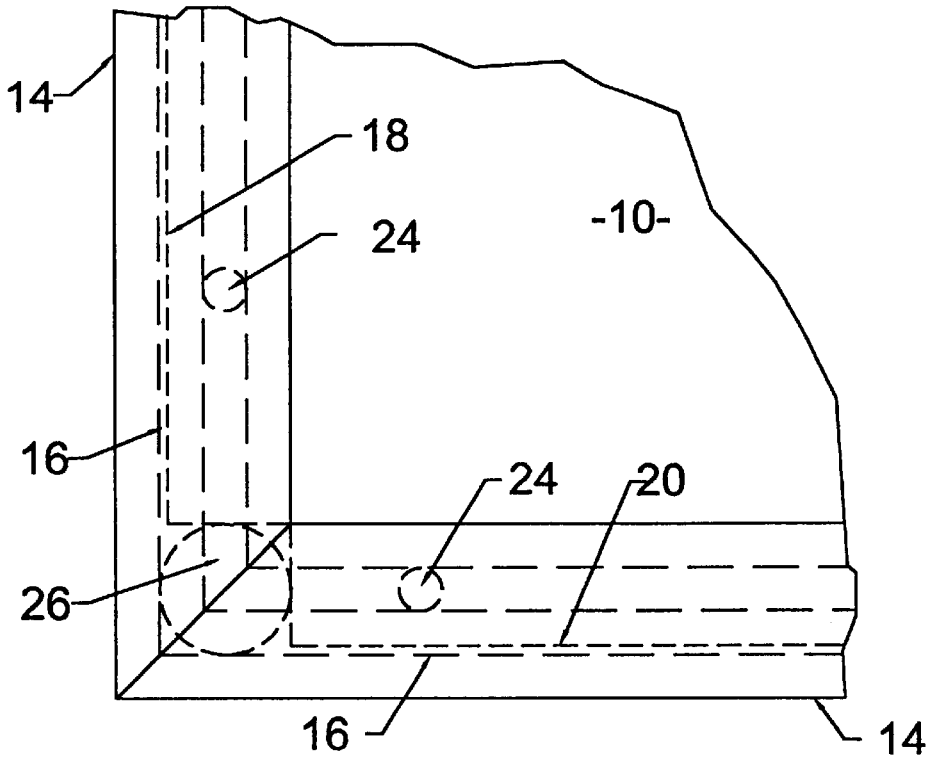
FIG.4 (PRIOR ART)
FIG. 4 illustrates the void defined by the channels and slots of conventional edge strips when joined to form a corner junction over a modified mother plate.

Conventional strips are also often mitered at a 45-degree angle for corner junctions, as illustrated in FIG. 3. Therefore, when these edge strips are installed on a modified electrode, the empty portions of channels 16 and slots 24 resulting from the missing section 12 of the modified electrode in adjoining ends of mitered edge strips create a void at the corner location, as approximately illustrated by the phantom-line circle 26 in FIG. 4. When electrolyte penetrates the seal formed by the mitered surfaces of the edge strips abutting at the corner, damaging deposits form in the cavity produced by the structure of the modified electrode.

Figure 5:
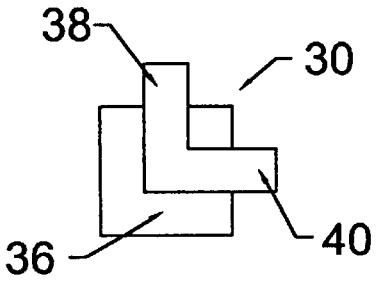
FIG. 5 is an elevational front view of an insert according to the invention.
Figure 6:
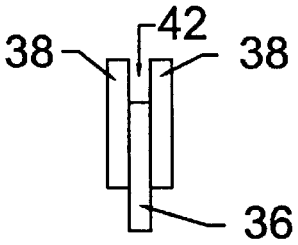
FIG. 6 is a side view of the insert of FIG. 5.
Figure 7:
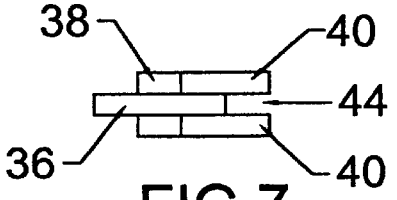
FIG. 7 is a top view of the insert of FIG. 5.

According to the present invention, a nonconductive insert 30, shown in FIGS. 5–7, is provided to fill the cavity defined by the channels 16, the slots 22, and the cut-out corner edges 32 and 34 of the modified mother plate 10. Accordingly, the insert 30 includes a plate 36 of dimensions substantially equal to the section 12 removed from the corner of the mother plate 10 for which the invention is intended, so that the insert 30 will fill the void created by its removal. In addition, the insert 30 includes orthogonal anchors 38 and 40 projecting in the directions of the slots 22 in the edge strips mounted on the side and bottom of the modified mother plate. As better seen in the side and top views of FIGS. 6 and 7, each anchor 38,40 is sized so that it can be press-fit around the edge of the mother plate 10 through the end of a corresponding slot 22. Specifically, referring to the side view of FIG. 6, the opening 42 within two prongs of the anchor 38 is adapted to receive the edge 32 of the mother plate; and the opening 44 within two prongs of the anchor 40 is adapted to receive the edge 34 of the plate in tight frictional connection. Each prong is sized to fit in the longitudinal openings left in the slot 22 on either side of the mother plate after the edge strip is mounted on the plate.

Figure 10:
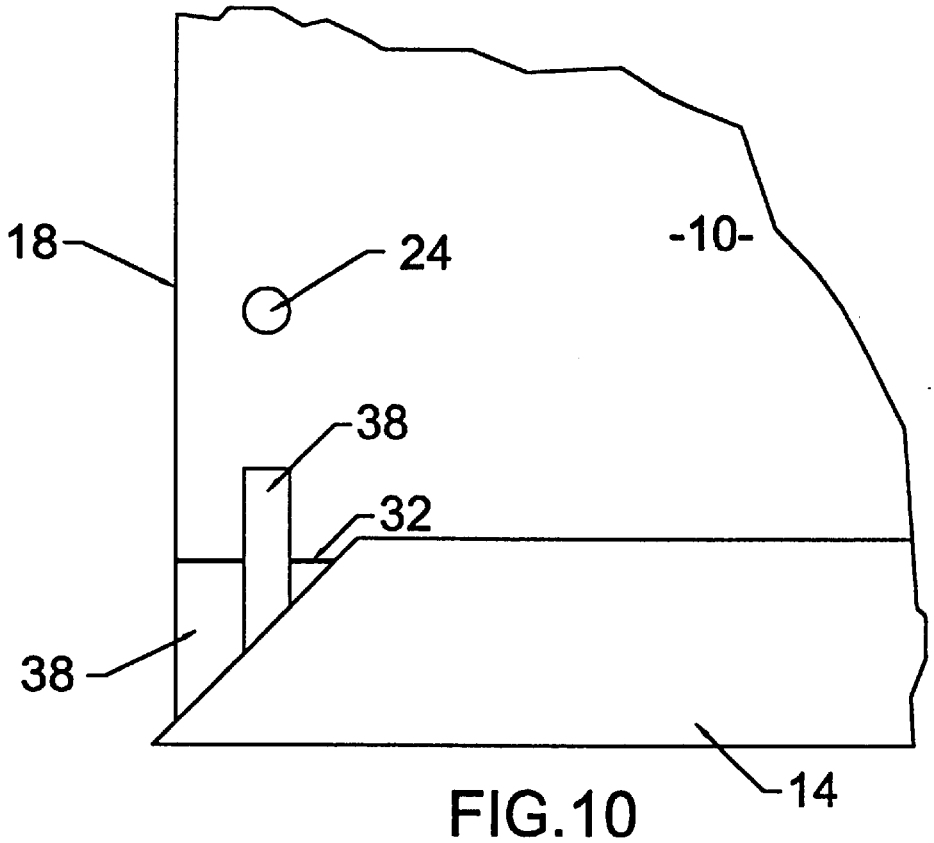
FIG. 10 illustrates the edge strip assembly of FIG. 8 installed on the bottom edge of a modified mother plate.
Figure 8:
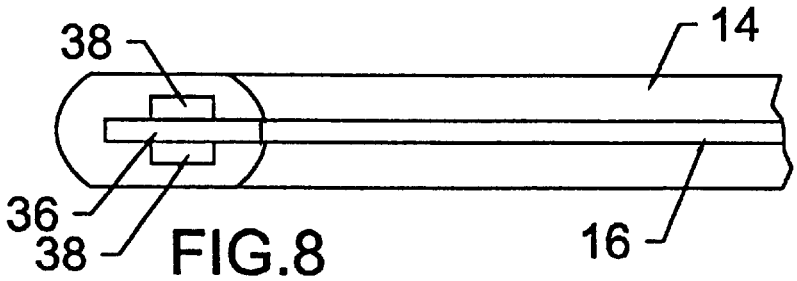
FIG. 8 is a top view of a strip edge including the insert of the invention, either as a separate component fitted into the end slot of the strip, or as an integral part thereof.
Figure 9:
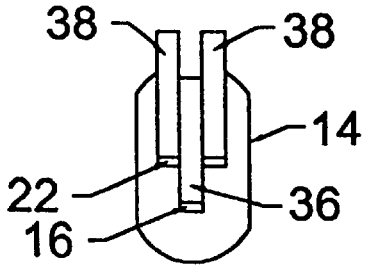
FIG. 9 is a side view of the edge strip assembly of FIG. 8.

FIGS. 8 and 9 illustrate in top and side views, respectively, the insert 30 of the invention as it would appear when inserted into a single edge strip 14. FIG. 10 shows the same partial assembly mounted on the bottom edge of a mother plate 10. As one can appreciate from these figures, it is clear that the further installation of a vertical edge strip by sliding it into position through the retaining pins 24 and the anchor 38 (in the slot 22) produces a compact corner assembly with essentially no residual empty space. In order to complete the elimination of interstices within the corner junction and further strengthen the assembly, a glue may be applied to all abutting surfaces during installation. Inasmuch as the insert 30 is made of nonconductive material, preferably the same as the main constituent of the edge strips, the edges 32 and 34 of the modified electrode are fully protected from electrical contact with the electrolyte solution and the corner sections are thereby durably prevented from accumulating metallic deposits.

Figure 2:
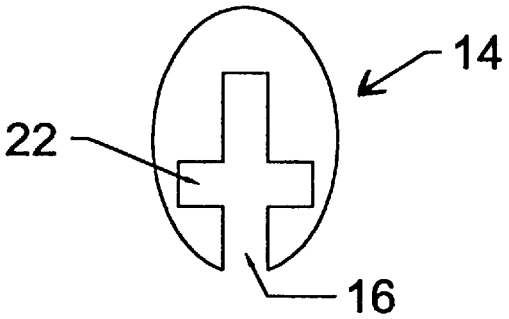
FIG.2 (PRIOR ART)
FIG. 2 is an end view of a conventional edge strip.

In the preferred embodiment of the invention, the insert 30 is sized to fit a conventional edge strip of the type illustrated in FIG. 2. Accordingly, the plate 36 is approximately 16 mm long, 16 mm wide, and 3 mm thick. The anchors 38,40 are about 20 mm long, 7 mm wide, and extend about 10 mm beyond the plate 36. Each prong in the anchors is defined by a 3-mm opening (42,44) for receiving the edge (32,34) of a mother plate 10.

The insert 30 of the invention has been described as a separate accessory component for use with conventional edge strips. On the other hand, the insert could be equivalently incorporated as an integral part of an edge strip of unitary construction. Such an embodiment would have exactly the same appearance of the assembly shown in FIGS. 8 and 9, but it would consist of a single-piece, preferably injection-molded, unit.

Figure 11:
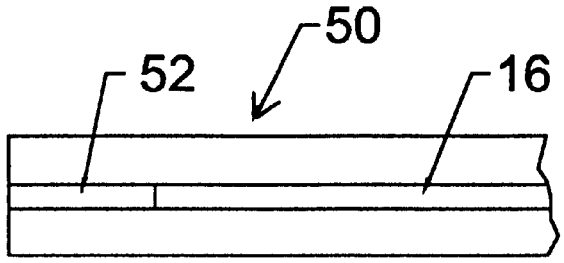
FIG. 11 illustrates an edge strip of unitary construction with a solid end plug designed for vertical-edge applications where a bottom edge strip is not used.
Figure 12:
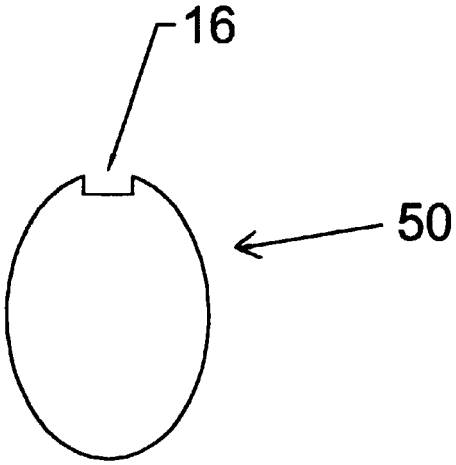
FIG. 12 is an end view of the edge strip of FIG. 11.
Figure 13:
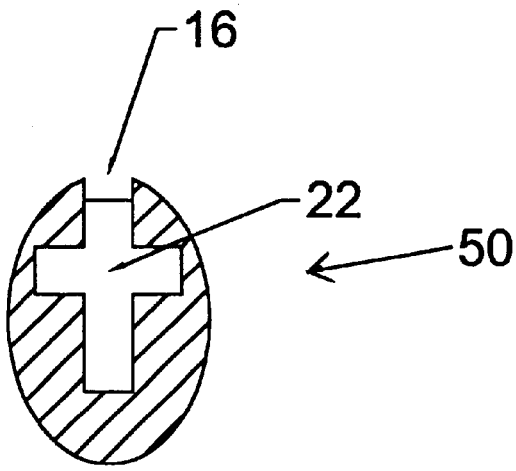
FIG. 13 is a sectional view of the edge strip of FIG. 11.

Similarly, an equivalent edge strip 50 of unitary construction, illustrated in FIGS. 11–13, is disclosed for vertical-edge applications where a bottom edge strip is not used. The strip 50 features a solid end plug 52 (seen in FIG. 11) designed to replace the corner section 12 removed from the modified mother plate 10. Accordingly, the end view of the strip shows a solid flat surface, as seen in FIG. 12. Otherwise, the strip 50 retains the same structural features of a conventional edge strip, including a channel 16 for receiving the edge of the mother plate and a slot 22 (seen in the cross-section of FIG. 13) for retaining pins 24.

It is clear that the insert of the invention has been described in terms of a conventional edge strip characterized by a longitudinal channel and a slot having the geometry illustrated in the figures. As one skilled in the art would readily understand, though, the invention can be used in equivalent fashion with any other type of edge strip, the fundamental idea being only to replace the missing corner piece of the mother plate with a nonconductive filler plug and, preferably, also with a binding material obviously, an insert designed for a different type of edge strip would have to be modified to conform to the specific interior geometry of the strip.

Various changes in the details, steps and components that have been described may be made by those skilled in the art within the principles and scope of the invention herein illustrated and defined in the appended claims. Therefore, while the present invention has been shown and described herein in what is believed to be the most practical and preferred embodiments, it is recognized that departures can be made therefrom within the scope of the invention, which is not to be limited to the details disclosed herein but is to be accorded the full scope of the claims so as to embrace any and all equivalent processes and products.

We claim:

1. A corner insert for use with a first edge strip for an electrode modified by the removal of a corner section therefrom, comprising:

a plate with dimensions substantially equal to said corner section; and first means for anchoring the plate to the first edge strip.

2. The corner insert of claim 1, further comprising second means for anchoring the plate to a second edge strip.

3. The corner insert of claim 2, wherein said first edge strip and second edge strip are disposed substantially at a right angle.

4. The corner insert of claim 2, wherein said plate and first edge strip constitute an integral body of unitary construction.

5. The corner insert of claim 2, wherein said first edge strip includes a longitudinal first slot and said first means for anchoring the plate to the first edge strip comprises a first prong adapted to engage the first slot; and wherein said second edge strip includes a longitudinal second slot and said second means for anchoring the plate to the second edge strip comprises a second prong adapted to engage the second slot.

6. The corner insert of claim 5, wherein said plate and first edge strip constitute an integral body of unitary construction.

7. The corner insert of claim 5, wherein said first edge strip and second edge strip are disposed substantially at a right angle.

8. The corner insert of claim 1, wherein said plate and first edge strip constitute an integral body of unitary construction.

9. The corner insert of claim 1, wherein said first edge strip includes a longitudinal first slot and said first means for anchoring the plate to the first edge strip comprises a first prong adapted to engage the first slot.

10. The corner insert of claim 9, wherein said plate and first edge strip constitute an integral body of unitary construction.

11. A corner insert incorporated into an edge strip for use with an electrode modified by the removal of a corner section therefrom, comprising:

an edge strip with a longitudinal slot for receiving an edge of the electrode; and an insert with dimensions substantially equal to said corner section of the electrode, said insert being integrally formed within the slot to fill the corner section when the edge strip is installed on the edge of the electrode.

12. A method of preventing electrolyte deposition within a corner junction between a first edge strip and a second edge strip mounted on an electrode modified by the removal of a corner section therefrom, comprising the following steps:

providing a plate insert with dimensions substantially equal to said corner section;

anchoring the plate insert to the first edge strip in a position designed to replace the corner section removed from the electrode upon installation of the first edge strip; and installing the first and second edge strips on the electrode.

13. The method of claim 12, further comprising the additional step of anchoring the plate insert to the second edge strip.

14. The method of claim 13, wherein said anchoring step comprises incorporating the plate insert into the first edge strip as an integral body of unitary construction.

15. The method of claim 13, wherein said first edge strip includes a longitudinal first slot and said anchoring step comprises providing a first prong in said plate insert adapted to engage the first slot; and wherein said second edge strip includes a longitudinal second slot and said additional anchoring step comprises providing a second prong in said plate insert adapted to engage the second slot.

16. The method of claim 15, wherein said anchoring step comprises incorporating the plate insert into the first edge strip as an integral body of unitary construction.

17. The method of claim 12, wherein said anchoring step comprises incorporating the plate insert into the first edge strip as an integral body of unitary construction.

18. The method of claim 12, wherein said first edge strip includes a longitudinal first slot and said anchoring step comprises providing a first prong in said plate insert adapted to engage the first slot.

19. The method of claim 18, wherein said anchoring step is comprises incorporating the plate insert into the first edge strip as an integral body of unitary construction.

* * * * *